US008991965B2

(12) United States Patent
Wakita

(10) Patent No.: US 8,991,965 B2
(45) Date of Patent: Mar. 31, 2015

(54) LIQUID EJECTING APPARATUS AND LIQUID EJECTING METHOD

(75) Inventor: Masaaki Wakita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 242 days.

(21) Appl. No.: 13/476,715

(22) Filed: May 21, 2012

(65) Prior Publication Data

US 2012/0299991 A1 Nov. 29, 2012

(30) Foreign Application Priority Data

May 24, 2011 (JP) ..... 2011-116048

(51) Int. Cl.

| | |
|---|---|
| ***B41J 29/38*** | (2006.01) |
| ***B41J 11/66*** | (2006.01) |
| ***B26D 1/06*** | (2006.01) |
| *B26D 1/60* | (2006.01) |
| *B26D 7/00* | (2006.01) |

(52) U.S. Cl.

CPC ..... *B41J 11/663* (2013.01); *B26D 1/065* (2013.01); *B26D 1/605* (2013.01); *B26D 2007/005* (2013.01)

USPC ..... 347/16; 347/101

(58) Field of Classification Search

USPC ..... 347/16, 101

See application file for complete search history.

(56) References Cited

U.S. PATENT DOCUMENTS

| | | | | |
|---|---|---|---|---|
| 3,761,675 | A * | 9/1973 | Mason et al. | 219/121.67 |
| 5,042,339 | A * | 8/1991 | Gerber | 83/49 |
| 5,074,178 | A * | 12/1991 | Shetley et al. | 83/47 |
| 5,141,572 | A * | 8/1992 | Gerber | 156/64 |
| 5,303,624 | A * | 4/1994 | Ventham et al. | 83/202 |
| 5,537,135 | A | 7/1996 | Hevenor et al. | |
| 6,091,928 | A * | 7/2000 | Fuchisawa | 399/384 |
| 6,112,630 | A | 9/2000 | Miura | |
| 6,201,256 | B1 | 3/2001 | Kouchi et al. | |
| 6,491,361 | B1 * | 12/2002 | Spann | 347/2 |
| 6,930,802 | B2 * | 8/2005 | Sugaya et al. | 358/296 |
| 6,945,645 | B2 * | 9/2005 | Baron | 347/104 |
| 7,054,708 | B1 * | 5/2006 | Aamodt et al. | 700/122 |
| 7,190,492 | B2 * | 3/2007 | Hakkaku | 358/304 |
| 8,101,883 | B2 * | 1/2012 | Sukhman et al. | 219/121.67 |
| 8,636,431 | B2 * | 1/2014 | Crystal et al. | 400/621 |
| 8,657,512 | B2 * | 2/2014 | Crystal et al. | 400/621 |
| 2007/0115300 | A1 * | 5/2007 | Barney et al. | 345/619 |

FOREIGN PATENT DOCUMENTS

| | | | | |
|---|---|---|---|---|
| JP | 2003225889 | A * | 8/2003 | B26D 5/26 |
| JP | 2006-281684 | | 10/2006 | |

* cited by examiner

*Primary Examiner* — Jannelle M Lebron
*Assistant Examiner* — Jeremy Bishop
(74) *Attorney, Agent, or Firm* — Workman Nydegger

(57) ABSTRACT

A liquid ejecting apparatus includes: a transport roller that transports a medium in a transport direction; a head that moves in a direction orthogonal to the transport direction, and ejects liquid to the medium; a cutter that moves in the transport direction and the orthogonal direction and cuts a part of the medium positioned in a predetermined range from a first position to a second position in the transport direction; and a controller that performs a first process of forming an image on the medium by controlling the transport roller to transport the medium in the transport direction and controlling the head moving in the orthogonal direction to eject the liquid, and performs a second process of forming a cutting line on the medium by controlling the cutter to cut the part of the medium over the predetermined range during the first process.

6 Claims, 7 Drawing Sheets

LIQUID EJECTING APPARATUS AND LIQUID EJECTING METHOD

BACKGROUND

1. Technical Field

The present invention relates to a liquid ejecting apparatus and a liquid ejecting method.

2. Related Art

A liquid ejecting apparatus such as an ink jet printer is already well known.

The liquid ejecting apparatus is provided with a transport roller that transports a medium in a transport direction, a head that moves in a direction orthogonal to the transport direction and ejects liquid to the medium, and a cutter that moves in the transport direction and the orthogonal direction and cuts only a part of the medium positioned in a predetermined range from a first position to a second position in the transport direction.

An example of the related art is disclosed in JP-A-2006-281684.

In the liquid ejecting apparatus, to perform the cutting operation performed by the cutter in parallel with the liquid ejecting operation performed by the head, a station is divided into a cutting station and a printing station, and thus the number of components may be thereby increased.

SUMMARY

An advantage of some aspects of the invention is to shorten the time necessary for the process of forming an image and a cutting line while reducing the number of components.

According to an aspect of the invention, there is provided a liquid ejecting apparatus including: a transport roller that transports a medium in a transport direction; a head that moves in a direction orthogonal to the transport direction, and ejects liquid to the medium; a cutter that moves in the transport direction and the orthogonal direction and cuts only a part of the medium positioned in a predetermined range from a first position to a second position in the transport direction; and a controller that performs an image forming process of forming an image on the medium by alternately repeating a transport operation of controlling the transport roller to transport the medium in the transport direction and liquid ejecting operation of controlling the head moving in the orthogonal direction to eject the liquid, and performs a cutting line forming process of forming a cutting line on the medium by performing a cutting operation of controlling the cutter to cut the part of the medium over the predetermined range by the transport operation during the image forming process in parallel with the liquid ejecting operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
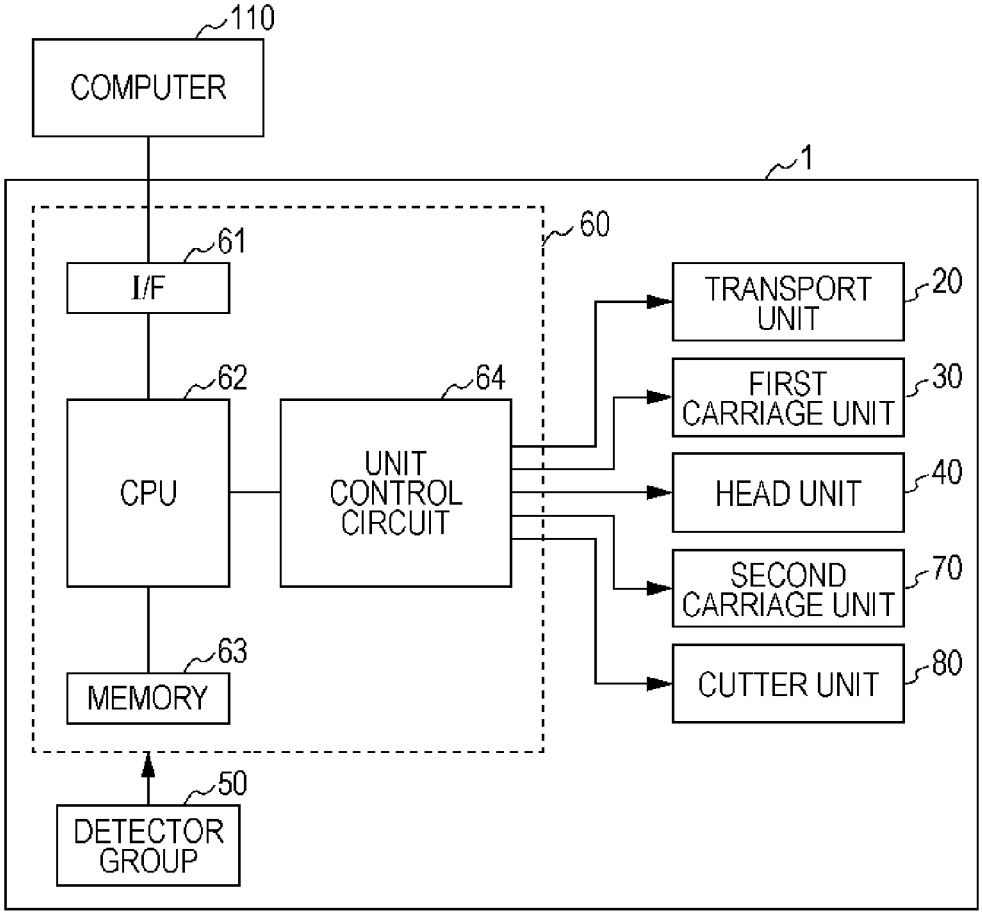
FIG. 1 is a block diagram illustrating a liquid ejecting apparatus.

At least the following are clarified by the specification and the accompanying drawings.

According to an aspect of the invention, there is provided a liquid ejecting apparatus including: a transport roller that transports a medium in a transport direction; a head that moves in a direction orthogonal to the transport direction, and ejects liquid to the medium; a cutter that moves in the transport direction and the orthogonal direction and cuts only a part of the medium position in a predetermined range from a first position to a second positioned in the transport direction; and a controller that performs an image forming process of forming an image on the medium by alternately repeating a transport operation of controlling the transport roller to transport the medium in the transport direction and liquid ejecting operation of controlling the head moving in the orthogonal direction to eject the liquid, and performs a cutting line forming process of forming a cutting line on the medium by performing a cutting operation of controlling the cutter to cut the part of the medium over the predetermined range by the transport operation during the image forming process in parallel with the liquid ejecting operation.

With such a configuration, it is possible to shorten the time necessary for the process of forming the image and the cutting line while reducing the number of components.

In the liquid ejecting apparatus, the controller may perform the image forming process, and may perform, many times, the cutting operation of controlling the cutter to cut the part of the medium over the predetermined range by the transport operation during the image forming process, in parallel with the liquid ejecting operation of many times, to perform the cutting line forming process of forming a cutting line in which a length in the transport direction is longer than a distance from the first position to the second position in the transport direction.

With such a configuration, even when the predetermined range (distance from the first position to the second position in the transport direction) is small to make the unit compact, it is possible to form a long cutting line.

In the liquid ejecting apparatus, the distance from the first position to the second position in the transport direction may be set to be equal to the maximum transport amount of transporting the medium in the transport operation during the image forming process.

With such a configuration, it is possible to make the unit as compact as possible while achieving reliable cutting.

In the liquid ejecting apparatus, the controller may perform the image forming process, and may perform the cutting line forming process of performing the cutting operation whenever the liquid ejecting operation is performed, in parallel with the liquid ejecting operation, to form the cutting line on the medium.

With such a configuration, the control is simple and easy.

In the liquid ejecting apparatus, the controller may perform the image forming process, and may perform the cutting line forming process of forming the cutting line on the medium by performing the cutting operation of controlling the cutter to cut both of the part of the medium over the predetermined range by any transport operation in the repeatedly performed transport operation and the part of the medium over the predetermined range by the pre-transport operation performed before the any transport operation, in parallel with the liquid ejecting operation performed subsequently to the transport operation.

With such a configuration, it is possible to efficiently perform the cutting when the transport amount in the transport operation is small.

According to another aspect of the invention, there is provided a liquid ejecting method including: repeatedly performing a transport operation of controlling the transport roller transporting the medium in the transport direction to transport the medium in the transport direction and a liquid ejecting operation of controlling a head moving in a direction orthogonal to the transport direction to eject liquid; performing an image forming process of forming an image on the medium; performing a cutting operation of controlling a cutter moving in the transport direction and the orthogonal direction and cutting only a part of the medium positioned in a predetermined range from a first position to a second position in the transport direction, to cut the part of the medium over the predetermined range by the transport operation during the image forming process, in parallel with the liquid ejecting operation; and performing a cutting line forming process of forming a cutting line on the medium.

With such a configuration, it is possible to shorten the time necessary for the process of forming the image and the cutting line while reducing the number of components.

Configuration Example of Liquid Ejecting Apparatus 1

Figure 2:
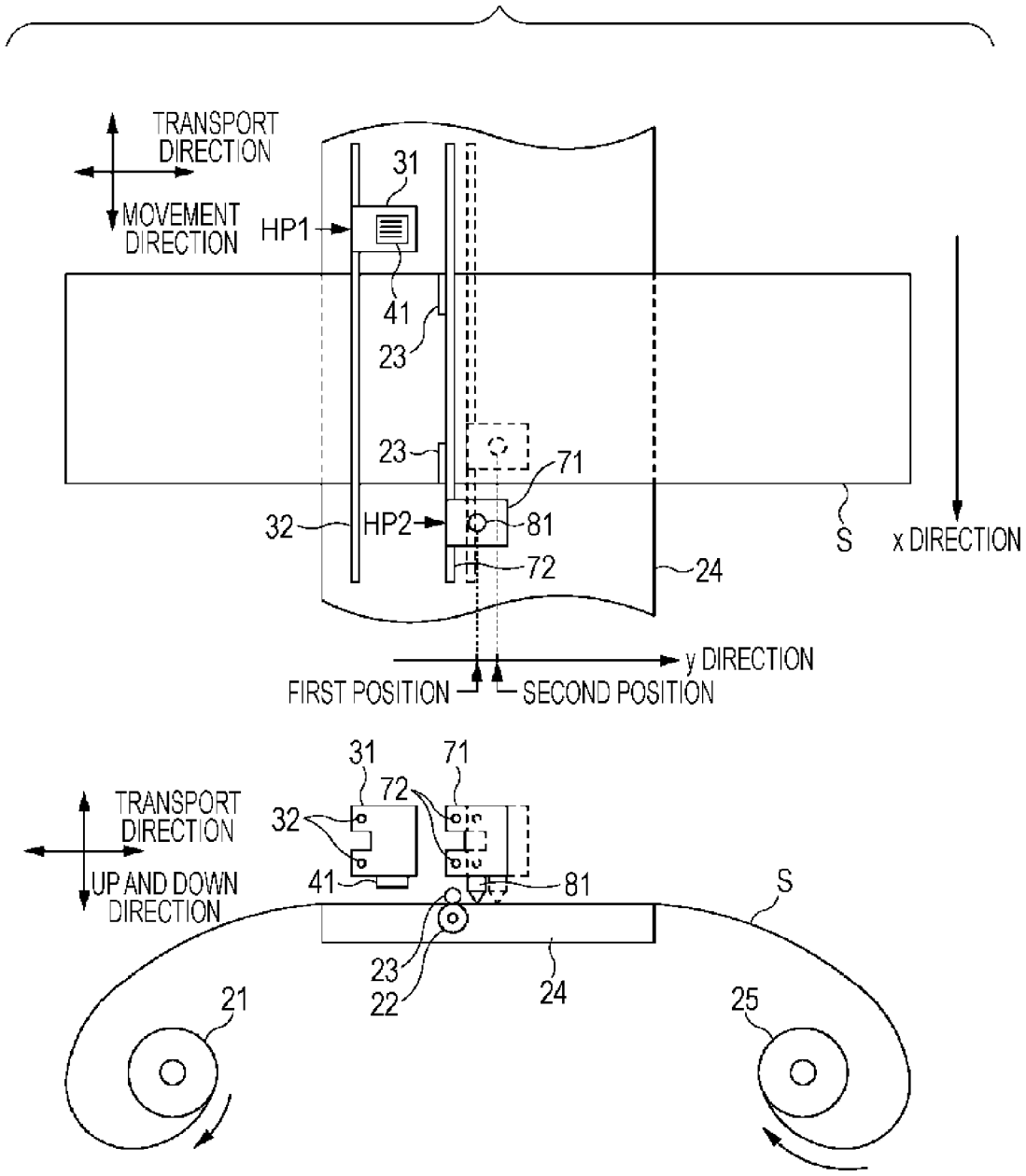
FIG. 2 is a schematic diagram illustrating a configuration of the liquid ejecting apparatus.

A configuration example of a liquid ejecting apparatus 1 such as an ink jet printer will be described with reference to FIG. 1 and FIG. 2. FIG. 1 is a block diagram illustrating the liquid ejecting apparatus 1. FIG. 2 is a schematic diagram illustrating a configuration of the liquid ejecting apparatus 1.

In the embodiment, as a medium on which the liquid ejecting apparatus 1 prints an image, a roll-shaped wound sheet (hereinafter, referred to as a roll sheet (continuous sheet)) will be described.

As shown in FIG. 1, the liquid ejecting apparatus 1 of the embodiment includes a transport unit 20, a first carriage unit 30, a head unit 40 that performs printing, a second carriage unit 70, a cutter unit 80 that performs cutting, a detector group 50, and a controller 60 that controls the units and the like to perform an operation of the liquid ejecting apparatus 1.

For this reason, when the liquid ejecting apparatus 1 receives printing data and cutting data from a computer 110 that is an external apparatus, it is possible to control the units by the controller 60. That is, the controller 60 controls the units on the basis of the printing data (data relating to dots formed on the roll sheet) received from the computer 110 to print (form) an image on the roll sheet (image forming process). The controller 60 controls the units on the basis of the cutting data (data relating to cutting lines formed on the roll sheet) received by the computer 110 to cut the roll sheet (cutting line forming process). The situation in the liquid ejecting apparatus 1 is monitored by the detector group 50, and the detector group 50 outputs the detection result to the controller 60. The controller 60 controls the units on the basis of the detection result output from the detector group 50.

Transport Unit 20

The transport unit 20 transports the roll sheet S in a predetermined direction (hereinafter, referred to as a transport direction, a direction of actually transporting the roll sheet S in the transport direction is called a y direction, see FIG. 2) in which the roll sheet S is continuous. As shown in FIG. 2, the transport unit 20 includes a feeding roller 21, a transport roller 22, a driven roller 23, a platen 24, and a winding roller 25.

The feeding roller 21 has a rotatably supported winding shaft on which the roll sheet S is wound, and is a roller that continuously feeds the roll sheet S from the winding shaft to feed the roll sheet S to the platen 24 side.

The transport roller 22 is a roller that transports the roll sheet S fed by the feeding roller 21 in the transport direction, and is driven by a transport motor (PF motor) (not shown). As shown in FIG. 2, the transport roller 22 in the embodiment is provided between the feeding roller 21 and the winding roller 25.

The driven roller 23 is a roller that is rotated by the rotation of the transport roller 22. The driven roller 23 in the embodiment is disposed to be opposed to the transport roller 22 with the roll sheet S interposed therebetween.

The platen 24 supports a part of the roll sheet S opposed to the support face at the time of performing the image forming process and at the time of performing the cutting line forming process.

The winding roller 25 is a roller for winding the roll sheet S (the roll sheet subjected to cutting and printing) transported by the transport roller 22, and is driven by a winding motor (not shown).

First Carriage Unit 30

The first carriage unit 30 moves the head 41 in a direction (hereinafter, referred to as a movement direction, and a direction from HP1 to HP2 in the movement direction is called an x direction, see FIG. 2) orthogonal to the transport direction at the time of the printing operation. As shown in FIG. 2, the first carriage unit 30 includes a first carriage 31 that is provided with the head 41, a guide rail 32 that extends in the movement direction, and a print carriage motor (not shown). The first carriage 31 reciprocates along the guide rail 32 in the movement direction, and is driven by the print carriage motor. Transmission of rotation force of the print carriage motor to the first carriage 31 is realized by the known transmission mechanism formed of a gear, a pulley, a belt, and the like.

Head Unit 40

The head unit 40 ejects ink that is an example of the liquid to a part of the roll sheet S transported on the plate 24 by the transport unit 20. The head unit 40 has a head 41 (ejection head).

The head 41 moves in the movement direction, and ejects the ink to the roll sheet S. The head 41 has nozzle rows formed of a plurality of nozzles #1 to #N for each color such as yellow (Y), magenta (M), cyan (C), and black (K), on the bottom face thereof.

The nozzle rows are disposed in parallel at distance from each other along the movement direction of the head 41. The nozzles #1 to #N of each nozzle rows are linearly arranged along the transport direction of the roll sheet S. Each of the nozzles #1 to #N is provided with a piezoelectric element (not shown) as a driving element for ejecting ink droplets. The piezoelectric element extends according to a voltage application time when the voltage with a predetermined time width is applied between electrodes provided at both ends thereof, and deforms a side wall of a flow path. Accordingly, the volume of the flow path of the ink is contracted according to the extension and contraction of the piezoelectric element, and the ink corresponding to the contract amount is ejected from the nozzles #1 to #N as ink droplets.

The head 41 is provided on the first carriage 31. Accordingly, when the first carriage 31 moves in the movement direction, the head 41 also moves in the movement direction. The ink is discontinuously ejected while the head 41 moves in the movement direction, and thus dot lines (raster lines) along the movement direction are formed on the roll sheet S.

When the amount of ink in the head unit 40 is decreased by the ejection of the ink performed by the head 41, an ink supplement unit (not shown) provided for each color of the ink is connected to the head unit 40 (head 41) through an ink supply tube and thus it is possible to supplement each ink to the head unit 40 by the ink supplement unit.

As shown in FIG. 2, the head 41 (first carriage 31) waits at a home position HP1 when the printing operation is not performed. At the home position HP1, a cleaning unit (not shown) is provided. The cleaning unit has a cap, a suction pump, and the like. For this reason, when the first carriage 31 is positioned at the home position HP1, the cap (not shown) comes in close contact with the bottom face (nozzle face) of the head 41. When the suction pump (not shown) is operated in the close contact state, the ink in the head 41 is sucked together with thickened ink or paper dust. As described above, the clogging nozzles are recovered from the non-ejection state, and the cleaning of the head is completed.

Second Carriage Unit 70

The second carriage unit 70 moves a cutter 81 in the transport direction and the movement direction at the time of the cut operation. As shown in FIG. 2, the second carriage unit 70 includes a second carriage 71 that is provided with the cutter 81, a movable guide rail 72 that extends in the movement direction and is movable in the transport direction, a first cutting carriage motor (not shown) and a second cutting carriage motor (not shown).

The second carriage 71 reciprocates in the movement direction along the movable guide rail 72, and is driven by the first cutting carriage motor. The movable guide rail 72 reciprocates in the transport direction, and is driven by the second cutting carriage motor. Transmission of rotation force of the first cutting carriage motor to the second carriage 71 and transmission of rotation force of the second cutting carriage motor to the movable guide rail 72 are realized by the known transmission mechanism formed of a gear, a pulley, a belt, and the like.

Cutter Unit 80

The cutter unit 80 cuts a part of the roll sheet S transported on the platen 24 by the transport unit 20. The cutter unit 80 includes the cutter 81, and a moving coil (not shown).

The cutter 81 cuts the image printed on the roll sheet S along a periphery or the like thereof, and has a blade at the leading end portion. That cutter 81 is provided in the second carriage 71 engaging with the movable guide rail 72. Accordingly, when the second carriage 71 moves in the movement direction and the movable guide rail 72 moves in the transport direction, the cutter 81 also moves in the movement direction or the transport direction.

The moving coil is formed by winding a coil at the rear end portion of the cutter 81. When electric current flows in the coil, the cutter 81 is drawn into a fixed magnet (not shown) and moves downward. When the electric current does not flow in the coil, the cutter 81 is moved upward by urging force of a coil spring (not shown).

Accordingly, by moving the second carriage 71 and the movable guide rail 72 in the movement direction or the transport direction in the state where the controller 60 controls the electric current to flow in the moving coil, the blade of the cutter 81 coming in contact with the roll sheet S moves in the movement direction or the transport direction, and thus cutting line is formed on the roll sheet S.

As described above, the movable guide rail 72 is movable in the transport direction, but the movement is limited to a predetermined range (in FIG. 2, the range is represented by the movable guide rail 72 of a solid line and the movable guide rail 72 of a broken line). For this reason, the movement of the cutter 81 in the transport direction is also limited to a predetermined range (that is, the cutter 81 may not cut all parts of the roll sheet S on the platen 24). That is, the cutter 81 moves in the transport direction (and the movement direction), it is possible to cut only a part of the roll sheet S positioned in the predetermined rage (hereinafter, referred to as a cuttable range) from the first position (see FIG. 2) to the second position (see FIG. 2) in the transport direction.

The blade of the cutter 81 in the embodiment cuts only the surface sheet without cutting the base material (half cutting) when the roll sheet S is release paper, but may be changed to also cut the base material (full cutting) by replacing the blade at the leading end by the other kind of blade.

As shown in FIG. 2, the cutter 81 (second carriage 71) waits at the home position HP2 when the cutting operation is not performed.

Detector Group 50

The detector group 50 monitors the situation in the liquid ejecting apparatus 1, and is, for example, a rotary encoder that detects a rotation amount of the transport roller 22 and is used for a control such as transport of the medium, a sheet detecting sensor that detects whether or not there is the transported medium, and a linear encoder that detects a position of the first carriage 31 (head 41) in the movement direction, a position of a second carriage 71 (cutter 81) in the movement direction, and a position of the movable guide rail 72 in the transport direction.

Controller 60

The controller 60 is a control unit that controls the liquid ejecting apparatus 1. As shown in FIG. 1, the controller 60 includes an interface unit 61, a CPU 62, a memory 63, and a unit control circuit 64. The interface unit 61 performs transmission and reception of data between a host computer 110 that is an external apparatus and the liquid ejecting apparatus 1. The CPU 62 is an operation processing device that controls the whole of the liquid ejecting apparatus 1. The memory 63 secures an area for storing programs of the CPU 62 and a work area. The CPU 62 controls the units by the unit control circuit 64 according to the programs stored in the memory 63.

Operation Example of Liquid Ejecting Apparatus 1

Figure 4:
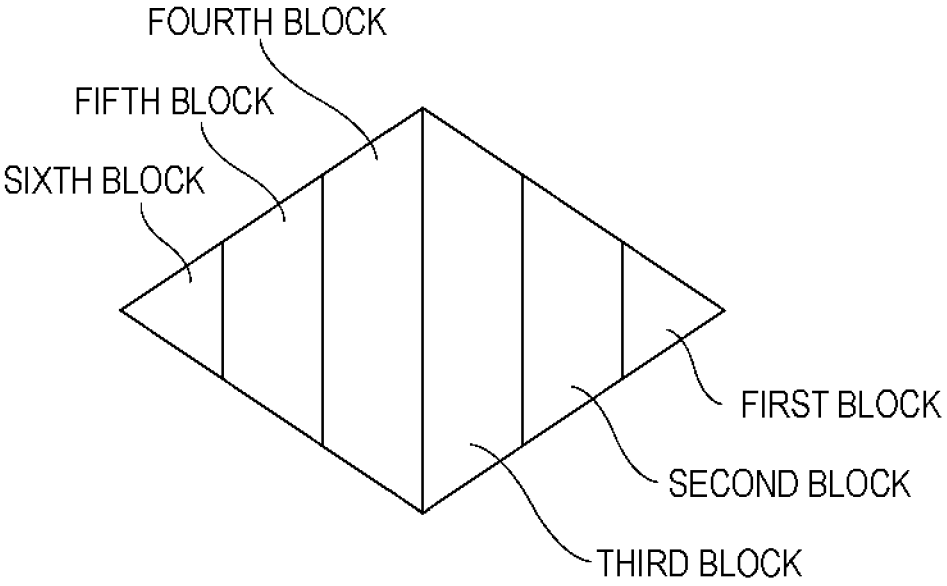
FIG. 4 is a diagram illustrating blocks of a diamond-shaped image.
Figure 5:
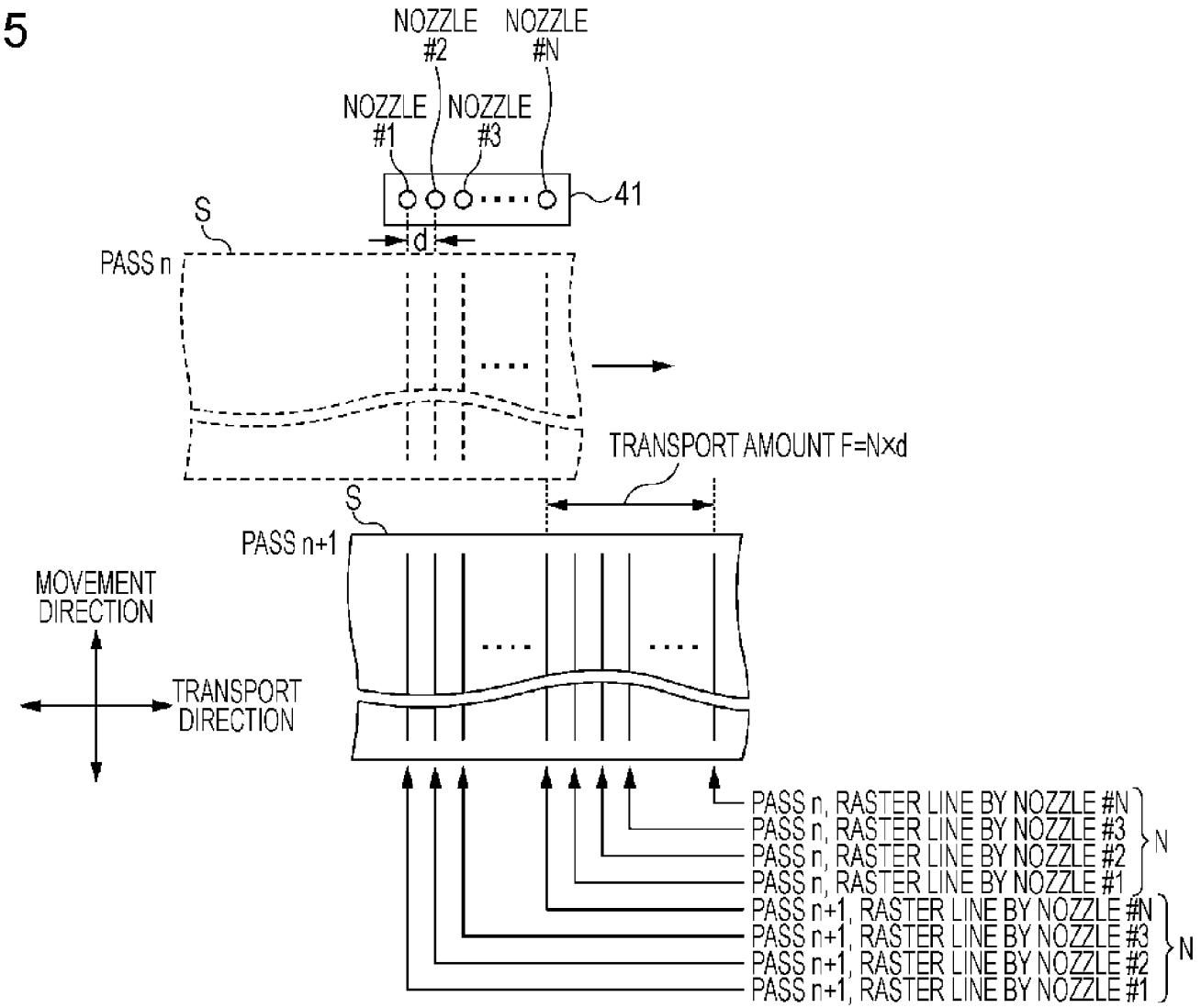
FIG. 5 is a schematic diagram illustrating band printing.

Next, as an operation example of the liquid ejecting apparatus 1, an example of an image forming process and an example of a cutting line forming process will be described with reference to FIG. 3A to FIG. 5. FIG. 3A to FIG. 3J are schematic diagrams illustrating an image and a cutting line formed on the roll sheet S, and show herein an operation example of forming a diamond-shaped image and forming a cutting line along the periphery of the diamond-shaped image. FIG. 3A to FIG. 3J show a shape after the N-th transport operation, a shape after the ink ejecting operation performed subsequently to the N-th transport operation, a shape after the (N+1)-th transport operation, a shape after the ink ejecting operation performed subsequently to the (N+1)-th transport operation, a shape after the (N+2)-th transport operation, a shape after the ink ejecting operation performed subsequently to the (N+2)-th transport operation, a shape after the (N+3)-th transport operation, a shape after the ink ejecting operation and the cutting operation performed subsequently to the (N+3)-th transport operation, a shape after the (N+4)-th transport operation, and a shape after the ink ejecting operation and the cutting operation performed subsequently to the (N+4)-th transport operation. FIG. 4 is a diagram illustrating blocks of the diamond-shaped image. FIG. 5 is a schematic diagram illustrating band printing.

Various operations of the liquid ejecting apparatus 1 are realized mainly by the controller 60. Particularly, in the embodiment, the CPU 62 processes the program stored in the memory 63 to realize various operations. The program is configured from codes for performing various operations to be described hereinafter.

Various operations are started from the time when the controller 60 receives the printing data and the cutting data from the computer 110 through the interface unit 61. The controller 60 analyzes the received printing data and cutting data, and performs the following processes using the units.

That is, the controller 60 alternately and repeatedly performs a transport operation of controlling the transport roller 22 to transport the roll sheet S in the transport direction and an ink ejecting operation of controlling the head 41 moving in the movement direction to eject the ink, to perform an image forming process of forming an image on the roll sheet S. Together with the execution of the image forming process, the cutting operation of controlling the cutter 81 to cut the part of the roll sheet S over the cuttable range described above by the transport operation during the image forming process is performed in parallel with the ink ejecting operation, thereby performing the cutting line forming process of forming the cutting line on the roll sheet S.

In the description, as a specific example, the operation of forming the diamond-shaped image and forming the cutting line along the periphery of the diamond-shaped image will be described with reference to FIG. 3A to FIG. 3J.

Figure 3A:
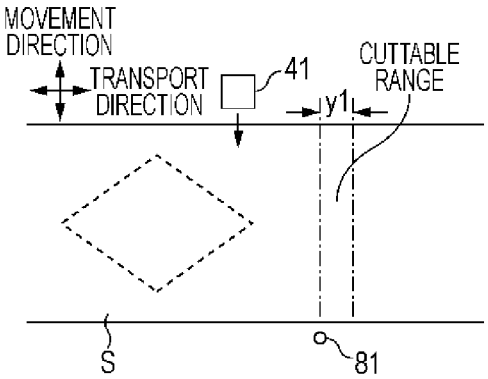
FIG. 3A to FIG. 3J are schematic diagrams illustrating an image and a cutting line formed on a roll sheet.

First, considering FIG. 3A. FIG. 3A is a schematic diagram illustrating the shape after the N-th transport operation as described above. In FIG. 3A, the diamond shape is represented by a dotted line, but the dotted line represents that the diamond-shaped image is not formed and the cutting line along the periphery of the diamond-shaped image is not formed, at the time point of FIG. 3A (the dotted line may represent the position on the roll sheet S where the diamond-shaped image and the cutting line are formed after the N-th transport operation). That is, at the time point of FIG. 3A, the diamond-shaped image and the cutting line are not formed on the roll sheet S.

Figure 3B:
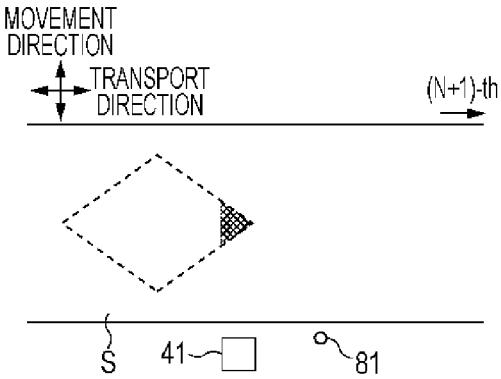

Then, the controller 60 controls the first carriage unit 30 and the head unit 40 to cause the head 41 to perform the following operation (FIG. 3A→FIG. 3B). That is, as shown in FIG. 3A and FIG. 3B, the head 41 ejects the ink from the nozzles #1 to #N while moving in the movement direction (see the arrow indicating the lower direction of FIG. 3A), to form a raster line (dot row) in which a plurality of dots are arranged in the movement direction, on the roll sheet S. By the operation of the head 41, the first block (see FIG. 4 about the blocks of the diamond-shaped image) of the diamond-shaped image is formed (in FIG. 3B, the first block is subjected to bold hatching, but the bold hatching represents that the first block (a part of the diamond-shaped image) is formed by the ink ejecting operation of FIG. 3B).

Figure 3C:
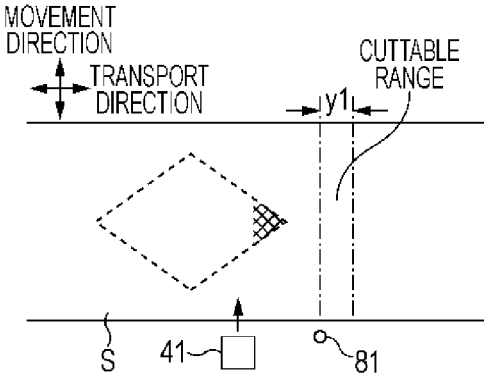

Then, the controller 60 controls the transport unit 20 to cause the transport roller 22 to perform the following operation (FIG. 3B→FIG. 3C). That is, as shown in FIG. 3B and FIG. 3C, the transport roller 22 transports the roll sheet S in the transport direction (see the arrow indicating the right direction of FIG. 3B). Accordingly, the (N+1)-th transport operation is performed.

The transport amount of transporting the roll sheet S in the transport direction is substantially equal to that of the width of the head 41 in the transport direction. That is, in the embodiment, as the image forming method, the known band printing is performed. Describing the band printing, as shown in FIG. 5, in the band printing, the ink is ejected from the nozzles #1 to #N by one pass (pass n or pass n+1 of FIG. 5) to form N raster lines, and the transport amount F of the roll sheet S between the passes (between the pass n and the pass n+1) in the transport direction becomes an amount (accurately, N (the number of nozzles)×d (distance between nozzles)) substantially equal to the width of the head 41 in the transport direction. The formation of the N raster lines and the transport of the roll sheet S of the transport amount F=n×d are alternately and repeatedly performed, thereby performing the image forming process.

Figure 3D:
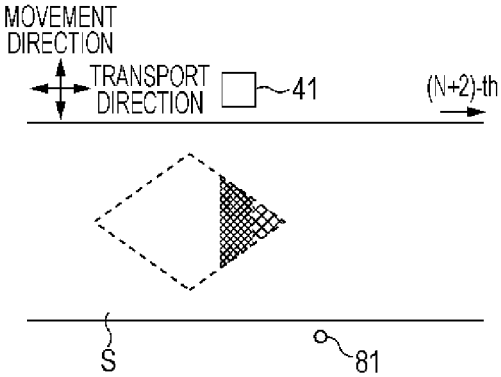
Figure 3E:
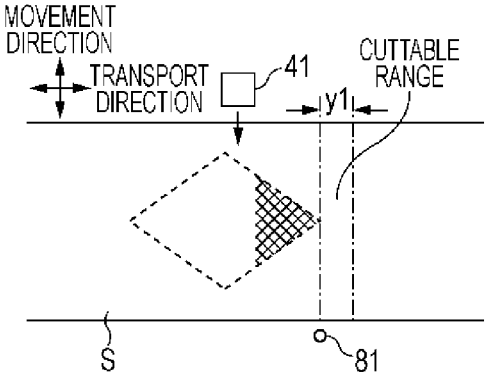
Figure 3F:
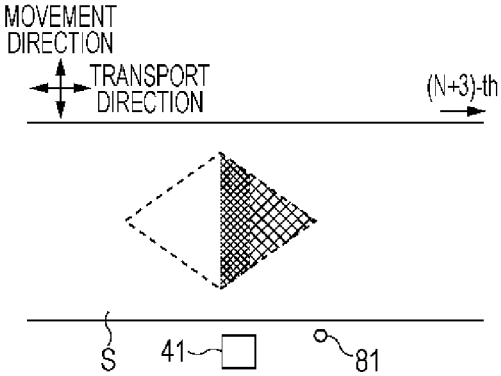

Then, the controller 60 controls the first carriage unit 30 and the head unit 40 to cause the head 41 to perform the following operation (FIG. 3C→FIG. 3D). That is, as shown in FIG. 3C and FIG. 3D, the head 41 ejects the ink from the nozzles #1 to #N while moving in the movement direction (see the arrow indicating the upper direction of FIG. 3C), to form a raster line (dot row) in which a plurality of dots are arranged in the movement direction, on the roll sheet S. By the operation of the head 41, the second block of the diamond-shaped image is formed (in FIG. 3D, the second block is subjected to bold hatching, but the bold hatching represents that the second block is formed by the ink ejecting operation of FIG. 3D. Meanwhile, the first block has been completely formed, but is not formed by the ink ejecting operation of FIG. 3D, and thus is represented by thin hatching (the same is applied to the first block in FIG. 3C)). As understood from the arrow indicating the lower direction of FIG. 3A and the arrow indicating the upper direction of FIG. 3C, in the embodiment, so-called two-way printing is performed.

Then, controller 60 controls the transport roller 22 to perform the (N+2)-th transport operation (FIG. 3D→FIG. 3E) of transporting the roll sheet S in the transport direction and, the ink ejecting operation (FIG. 3E→FIG. 3F) which is subsequent to the (N+2)-th transport operation that causes the head 41 moving in the movement direction to eject the ink, to form the third block of the diamond-shaped image.

Then, the controller 60 controls the transport roller 22 to perform the (N+3)-th transport operation (FIG. 3F→FIG. 3G) of transporting the roll sheet S in the transport direction, but the diamond-shaped image (specifically, the first block) reaches the cuttable range described above by the transport operation (see FIG. 3G). Accordingly, it is possible to form the cutting line along the periphery of the first block.

Figure 3G:
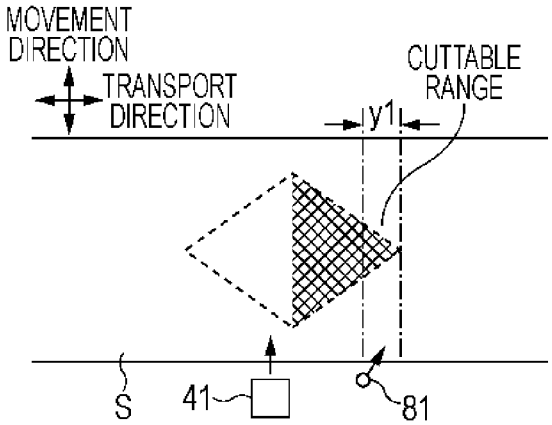
Figure 3H:
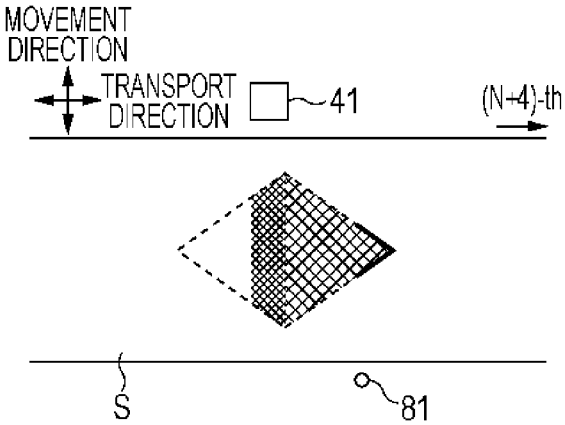
Figure 3I:
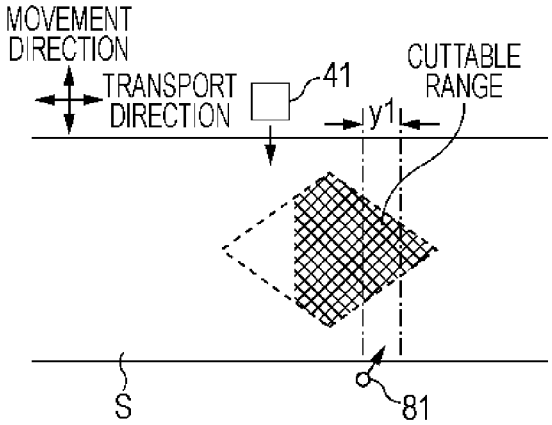

Then, the controller 60 controls the first carriage unit 30 and the head unit 40 to cause the head 41 to perform the following operation, and controls the second carriage unit 70 and the cutter unit 80 to cause the cutter 81 to perform the following operation (FIG. 3G→FIG. 3H). That is, as shown in FIG. 3G and FIG. 3H, the head 41 ejects the ink from the nozzles #1 to #N while moving in the movement direction (see the arrow indicating the upper direction of FIG. 3G), to form a raster line (dot row) in which a plurality of dots are arranged in the movement direction, on the roll sheet S. The fourth block of the diamond-shaped image is formed by the operation of the head 41.

In parallel with the ink ejecting operation (the fourth block forming operation), as shown in FIG. 3G and FIG. 3H, the cutter 81 cuts the part (that is, the periphery of the first block) of the roll sheet over the cuttable range by the (N+3)-th transport operation while moving in the movement direction and the transport direction (see the arrow indicating the upper right direction of FIG. 3G). By the operation of the cutter 81, the cutting line along the periphery of the first block is formed (in FIG. 3H, the periphery of the first block is not represented by a dotted line and is represented by a bold solid line, but the bold solid line represents that the periphery of the first block is cut by the cutting operation of FIG. 3H).

Then, the controller 60 controls the transport roller 22 to perform the (N+4)-th transport operation (FIG. 3H→FIG. 3I) of the roll sheet S in the transport direction. By the transport operation, this time, the second block reaches the cuttable range (see FIG. 3I), and it is possible to form the cutting line along the periphery of the second block.

Figure 3J:
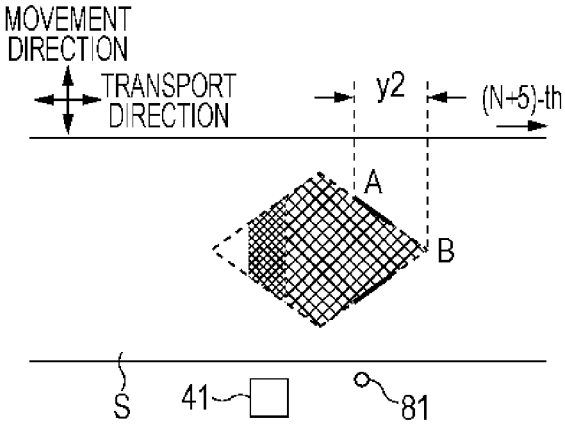

Then, the controller 60 performs the ink ejecting operation (FIG. 3I→FIG. 3J) subsequent to the (N+4)-th transport operation of causing the head 41 moving in the movement direction to eject the ink, to form the fifth block of the diamond-shaped image, and performs the cutting operation of causing the cutter 81 to cut the part (that is, the periphery of the second block) of the roll sheet over the cuttable range by the (N+4)-th transport operation, in parallel with the ink ejecting operation (the fifth block forming operation), to form the cutting line along the periphery of the second block, on the roll sheet S (in FIG. 3J, the periphery of the second block is represented by a bold solid line, but the bold solid line represents that the periphery of the second block is cut by the cutting operation of FIG. 3J. Meanwhile, the cutting line of the first block has been completely formed, but it is not formed by the cutting operation of FIG. 3J, and thus is represented by a thin solid line (the same is applied to the first block in FIG. 3I)).

Hereinafter, the controller 60 performs the transport operation after the (N+5)-th operation, and the ink ejecting operation and cutting operation subsequent thereto, to completely form the diamond-shaped image and the cutting line along the periphery of the diamond-shaped image.

Validity of Liquid Ejecting Apparatus 1 According to Embodiment

As described above, the liquid ejecting apparatus 1 according to the embodiment includes the transport roller 22 that transports the roll sheet S in the transport direction, the head 41 that moves in the movement direction and ejects the ink to the roll sheet S, the cutter 81 that moves in the transport direction and the movement direction and cuts only the part of the roll sheet S positioned in the cuttable range from the first position to the second position in the transport direction, and the controller (in the process of the controller 60, see, for example, FIG. 3G and FIG. 3H) that alternately and repeatedly performs the transport operation of controlling the transport roller 22 to transport the roll sheet S in the transport direction and the ink ejecting operation of controlling the head 41 moving in the movement direction to eject the ink, to perform the image forming process of forming the image on the roll sheet S, and performs the cutting operation of controlling the cutter 81 to cut the part of the roll sheet S over the cuttable range by the transport operation during the image forming process, in parallel with the ink ejecting operation, to perform the cutting line forming process of forming the cutting line on the roll sheet S. Accordingly, it is possible to shorten the time necessary for the process of forming the image and the cutting line while reducing the number of components.

Figure 6:
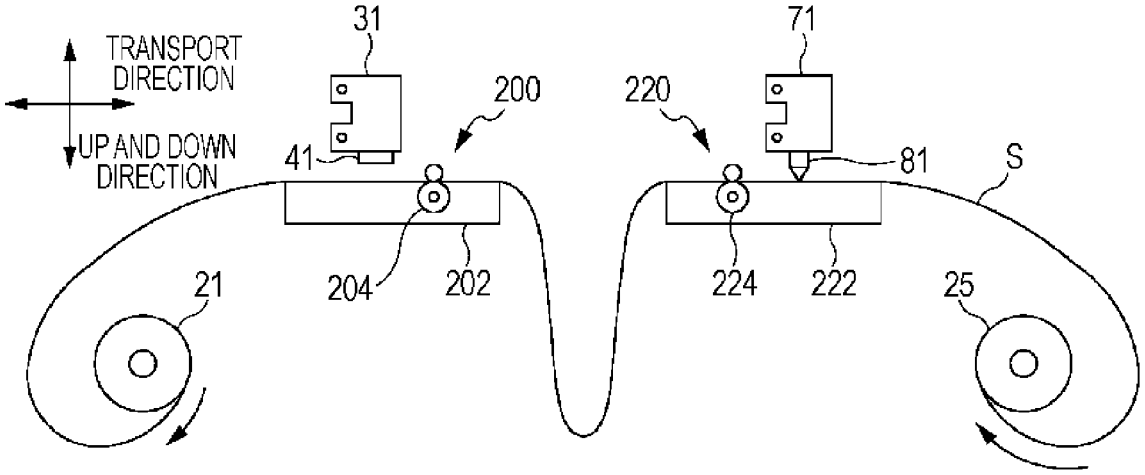
FIG. 6 is a schematic diagram illustrating a liquid ejecting apparatus according to a comparative example.

In the description, comparing the liquid ejecting apparatus 1 according to the embodiment with a liquid ejecting apparatus 1 according to a comparative example, the liquid ejecting apparatus 1 will be described with reference to FIG. 6. FIG. 6 is a schematic diagram illustrating the liquid ejecting apparatus 1 according to the comparative example.

In the liquid ejecting apparatus 1 according to the comparative example, similarly to the liquid ejecting apparatus 1 according to the embodiment, the cutting operation (cutting line forming process) may be performed in parallel with the ink ejecting operation (image forming process) to shorten the time necessary for the process of forming the image and the cutting line (that is, the cutting operation is not started after the ink ejecting operation is completed and the image is completely formed, but the ink ejecting operation and the cutting operation are simultaneously performed). To realize this, in the liquid ejecting apparatus 1 according to the comparative example, as shown in FIG. 6, the printing station 200 of performing the ink ejecting operation and the cutting station 220 of performing the cutting operation are provided, and both stations serve as each function in a completely divided state without interconnection (the roll sheet S is slack between both stations such that both functions reliably exhibit without interconnection of both stations). That is, the printing station 200 is provided with the first carriage 31, the head 41, a first platen 202, and a printing transport roller 204, and such members are controlled to perform the ink ejecting operation irrespective of the cutting operation. Meanwhile, the cutting station 220 is provided with the second carriage 71, the cutter 81, a second platen 222, and a cutting transport roller 224, and such members are controlled to perform the cutting operation irrespective of the ink ejecting operation.

As described above, in the liquid ejecting apparatus 1 according to the comparative example, the station is divided into the printing station 200 and the cutting station 220 such that the cutting operation is performed in parallel with the ink ejecting operation, but the liquid ejecting apparatus 1 has the following situation. That is, the number of components is increased such as the printing transport roller 204 and the cutting transport roller 224 have to be prepared as the transport roller.

On the contrary, in the liquid ejecting apparatus 1 according to the embodiment, the cutting operation of causing the cutter 81 to cut the part of the roll sheet S over the cuttable range by the transport operation (that is, the transport operation of controlling the transport roller 22 to transport the roll sheet S in the transport direction) during the image forming process is performed in parallel with the ink ejecting operation, and thus the transport operation of the roll sheet S based on the transport roller 22 and the cutting operation are interconnected. Since the transport operation and the ink ejecting operation are interconnected, three such operations are interconnected, and thus it is not necessary to prepare the transport roller by dividing the transport roller into printing and cutting. That is, in the embodiment, similarly to the comparative example, it is not necessary to prepare a plurality of transport rollers to perform the cutting operation in parallel with the ink ejecting operation, and thus it is possible to shorten the time necessary for the process of forming the image and the cutting line since the ink ejecting operation and the cutting operation are simultaneously performed while reducing the number of components. By the interconnection of three operations described above, the cuttable range may be the transport amount of the roll sheet S based on the transport operation during the image forming process (during the ink ejecting operation), and thus it is possible to reduce the cuttable range. In this case, it is possible to make the units such as the second carriage unit 70 compact.

In the embodiment, the controller 60 performs the image forming process, and performs, many times, the cutting operation (for example, the cutting operating in FIG. 3H and the cutting operation in FIG. 3J) of causing the cutter 81 to cut the part of the roll sheet S over the cuttable range by the transport operation during the image forming process, in parallel with the ink ejecting operation of many times (for example, the ink ejecting operation in FIG. 3H and the ink ejecting operation in FIG. 3J). Accordingly, the cutting line forming process of forming the cutting line (for example, the line AB in FIG. 3J) in which the length (for example, y2 in FIG. 3J) in the transport direction is longer than the distance (for example, y1 in FIG. 3I and the like) in the transport direction from the first position to the second position is performed. For this reason, even when the cuttable range (the distance in the transport direction from the first position to the second position) is small to make the unit compact, it is possible to form the long cutting line by forming the cutting line by the division of many times.

Other Embodiments

The embodiment described above has been described mainly about the liquid ejecting apparatus, but includes the disclosure of a liquid ejecting method and the like. The embodiment described above is made to easily understand the invention, and does not limit the invention. The invention may be modified and improved without deviating from the concept thereof, and it is obvious that the invention includes equivalents thereof. Particularly, the following embodiments are also included in the invention.

In the embodiment, the liquid ejecting apparatus (liquid spraying apparatus) has been specified as the ink jet printer, but a liquid ejecting apparatus that ejects and sprays the other liquid other than the ink may be employed, and may be diverted to various liquid ejecting apparatus provided with a liquid ejecting head ejecting a small amount of liquid droplets. The liquid droplets denote a state of liquid ejected from the liquid ejecting apparatus, and include a grain type, a tear type, and a filament type. The liquid described herein may be a material which can be ejected by the liquid ejecting apparatus. For example, when a substance may be a state of liquid, the liquid includes a liquid state with high or low viscosity, a flow state such as colloid solution, gel water, inorganic solvent, organic solvent, solution, liquid resin, and liquid metal (metal molten liquid), and liquid as one state of a substance, a material in which particles of a functional material formed of a solid material such as pigment and metal particles are dissolved, dispersed, and mixed in a solvent. As a representative example of the liquid, there is the ink described in the embodiment or liquid crystal. Herein, the ink includes various liquid composition materials such as general aqueous ink and oily ink, gel ink, hot melt ink. A specific example of the liquid ejecting apparatus may be, for example, a liquid crystal display, an EL (electroluminescence) display, a surface emitting display, a liquid ejecting apparatus that ejects liquid including a material such as an electrode material and a color material used to produce a color filter in a dispersion or solution state, a liquid ejecting apparatus that ejects a bio-organic material used to produce a bio chip, a liquid ejecting apparatus that is used as a precision pipette and eject liquid as a sample, and a printing apparatus, and a micro-dispenser. A liquid ejecting apparatus that ejects lubricant to a precision machine such as a clock and a camera by a pinpoint, a liquid ejecting apparatus that ejects transparent resin liquid such as ultraviolet curable resin on a substrate to form a micro-hemisphere lens (optical lens) used in an optical communication element, and a liquid ejecting apparatus that ejects etching liquid such as acid or alkali to etch the substrate or the like may be employed. The invention may be applied to any one kind of ejecting apparatuses.

In the embodiment, the roll sheet S has been described as an example of the medium, but the medium is not limited thereto, and may be a cut sheet. The medium may not be necessarily paper, and may be, for example, film and cloth.

The distance from the first position to the second position in the transport direction may be set to be equal to the maximum transport amount of transporting the medium in the transport operation during the image forming process. For example, a plurality of kinds of image forming method are performed for the liquid ejecting apparatus. When the transport amount is different in the methods, the distance in the transport direction from the first position to the second position may be set to be equal to the maximum transport amount of them.

When the distance in the transport direction from the first position to the second position is equal to or more than the maximum transport amount and even when the transport amount is any amount equal to or smaller than the maximum transport amount, it is possible to cause the cutter to reliably cut the part of the roll sheet over the cuttable range by the transport operation. When the distance is set to be equal to the maximum transport amount, the distance becomes smallest (in other words, the unit is made compact as possible) while securing the reliable cutting. That is, by setting the distance to be equal to the maximum transport amount, it is possible to make the unit compact as possible while realizing the reliable cutting.

In the embodiment, the controller 60 may perform the image forming process, and may perform the cutting line forming process of performing the cutting operation whenever the ink ejecting operation is performed, in parallel with the ink ejecting operation, to form the cutting line on the roll sheet S. That is, when there is the cutting data and the ink ejecting operation is performed, the controller 60 necessarily performs the cutting operation (for example, see FIG. 3H and FIG. 3J, in the embodiment, even in the sequence after FIG. 3J, when there is the cutting data, the cutting operation is performed in parallel with every time ink ejecting operation), all the parts of the roll sheet S over the cuttable range by the transport operation in the repeatedly performed transport operation are cut in the cutting operation performed in parallel with the ink ejecting operation performed subsequently to the transport operation (immediately after the transport operation) (see FIG. 3H and FIG. 3J).

However, the invention is not limited thereto. For example, the controller 60 may perform the image forming process, and performs the cutting line forming process of forming the cutting line on the roll sheet S by performing the cutting operation of controlling the cutter 81 to cut both of the part of the roll sheet S over the cuttable range by the pre-transport operation performed before the transport operation at the part of the roll sheet S over the cuttable range by the transport operation in the repeatedly performed transport operation, in parallel with the ink ejecting operation performed subsequently to the transport operation (immediately after the transport operation).

For example, the operation of causing the cutter 81 to cut the part of the roll sheet S over the cuttable range by the first to (M−1)-th (M is a number equal to or more than 2) transport operations is not performed in parallel with the ink ejecting operation performed subsequently to the first to (M−1)-th transport operations (immediately after the first to (M−1)-th transport operations), and may be performed in parallel with the ink ejecting operation performed subsequently to the M-th transport operation (immediately after the M-th transport operation), together with the part of the roll sheet S over the cuttable range by the M-th transport operation (that is, even when there is the cutting data, the controller 60 may not perform the cutting operation in parallel with the ink ejecting operation).

Comparing both, the former has superiority that the cutting operation is performed in parallel with the ink ejecting operation whenever the ink ejecting operation is performed and thus the control based on the controller 60 is simple and easy. Meanwhile, the latter has superiority that the part of the roll sheet S over the cuttable range by the transport operations of many times are collected and cut and thus it is possible to efficiently perform the cutting when the transport amount in the transport operation is small (for example, the image forming method is so-called interlacing printing).

The entire disclosure of Japanese Patent Application No. 2011-116048, filed May 24, 2011 is expressly incorporated by reference herein.

What is claimed is:

1. A liquid ejecting apparatus comprising:

a transport roller that transports a medium in a transport direction;

a head that moves in a movement direction that is orthogonal to the transport direction, and that ejects liquid to the medium;

a cutter that moves in the transport direction and the movement direction and cuts only a part of the medium positioned in a predetermined range from a first position to a second position in the transport direction, wherein the cutter cuts in both the transport direction and the movement direction in the predetermined range, wherein the cutter includes a blade for cutting the part of the medium; and a controller that:

performs an image forming process of forming an image on the medium by alternately repeating:

a transport operation of controlling the transport roller to transport the medium in the transport direction and a liquid ejecting operation of controlling the head moving in the movement direction to eject the liquid, and performs a cutting operation of controlling the cutter to cut the part of the medium over the predetermined range during the image forming process in parallel with the liquid ejecting operation, wherein the predetermined range is equal to a maximum transport amount of the medium during the image forming process.

2. The liquid ejecting apparatus according to claim 1, wherein the controller performs the image forming process, and performs, many times, the cutting operation of controlling the cutter to cut the part of the medium over the predetermined during the image forming process, in parallel with performing the liquid ejecting operation many times, to form a cutting line in which a length in the transport direction is longer than a distance from the first position to the second position in the transport direction.

3. The liquid ejecting apparatus according to claim 1, wherein the distance from the first position to the second position in the transport direction is set to be equal to a maximum transport amount of transporting the medium in the transport operation during the image forming process.

4. The liquid ejecting apparatus according to claim 1, wherein the controller performs the image forming process, and performs the cutting operation whenever the liquid ejecting operation is performed, in parallel with the liquid ejecting operation, to form a cutting line on the medium when there is cutting data.

5. The liquid ejecting apparatus according to claim 1, wherein the controller performs the image forming process, and performs the cutting operation of controlling the cutter to cut both of the part of the medium over the predetermined range by any transport operation in the repeatedly performed transport operation and the part of the medium over the predetermined range before the any transport operation, in parallel with the liquid ejecting operation performed subsequently to the transport operation.

6. A liquid ejecting method comprising:

performing an image forming process of forming an image on a medium by alternately and repeatedly performing:

a transport operation of controlling a transport roller to transport the medium in the transport direction and a liquid ejecting operation of controlling a head moving in a direction orthogonal to the transport direction to eject liquid;

performing a cutting line forming process of forming a cutting line on the medium by:

controlling a cutter moving in the transport direction and a movement direction that is orthogonal to the transport direction and cutting only a part of the medium positioned in a predetermined range from a first position to a second position in the transport direction with a blade, to cut the part of the medium over the predetermined range during the image forming process, in parallel with the liquid ejecting operation when there is cutting, controlling the cutter such that the cutter cuts in both the transport direction and the movement direction in the predetermined range, wherein the predetermined range is equal to a maximum transport amount of the medium during the image forming process.

* * * * *